US010002684B2

(12) United States Patent
Ito et al.

(10) Patent No.: US 10,002,684 B2
(45) Date of Patent: Jun. 19, 2018

(54) COPPER ALLOY AND METHOD FOR MANUFACTURING THE SAME

(75) Inventors: Takefumi Ito, Kanagawa (JP); Chisako Maeda, Kanagawa (JP); Yuji Yoshida, Kanagawa (JP); Kei Saegusa, Kanagawa (JP); Takayuki Kemmotsu, Tokyo (JP)

(73) Assignee: NGK Insulators, Ltd., Nagoya (JP)

( * ) Notice: Subject to any disclaimer, the term of this patent is extended or adjusted under 35 U.S.C. 154(b) by 550 days.

(21) Appl. No.: 14/413,300

(22) PCT Filed: Jul. 26, 2012

(86) PCT No.: PCT/JP2012/068937

§ 371 (c)(1),
(2), (4) Date: Jan. 7, 2015

(87) PCT Pub. No.: WO2014/016934

PCT Pub. Date: Jan. 30, 2014

(65) Prior Publication Data

US 2015/0170781 A1 Jun. 18, 2015

(51) Int. Cl.
*C22C 9/00* (2006.01)
*H01B 1/02* (2006.01)
(Continued)

(52) U.S. Cl.
CPC ..... *H01B 1/026* (2013.01); *C22C 9/06* (2013.01); *C22F 1/08* (2013.01); *C22F 1/002* (2013.01)

(58) Field of Classification Search
CPC ..... C22F 1/08; C22C 9/00; H01B 1/026
(Continued)

(56) References Cited

U.S. PATENT DOCUMENTS 4,260,432 A * 4/1981 Plewes ..... C22F 1/08 148/28
5,019,185 A 5/1991 Nakajima et al.
(Continued)

FOREIGN PATENT DOCUMENTS

CN 101014725 A 8/2007
CN 101605917 A1 12/2009
(Continued)

OTHER PUBLICATIONS

International Preliminary Report on Patentability and Written Opinion dated Feb. 5, 2015 in PCT/JP2012/068937.
(Continued)

*Primary Examiner* — Erin B Saad
(74) *Attorney, Agent, or Firm* — Burr & Brown, PLLC

(57) ABSTRACT

A copper alloy according to the present invention is a copper alloy rolled to be plate-shaped. The copper alloy contains 8.5 to 9.5 mass % of Ni, 5.5 to 6.5 mass % of Sn with a remainder being Cu and unavoidable impurities. An average diameter of crystal grains in a cross section perpendicular to a rolling direction is less than 6 μm. A ratio x/y of an average length x of the crystal grains in a plate width direction to an average length y in a plate thickness direction satisfies $1 \leq x/y \leq 2.5$. An X-ray diffracted intensity ratio in a plate surface parallel to the rolling direction of the copper alloy includes, when an X-ray diffracted intensity of a (220) plane is standardized as 1, an intensity ratio of a (200) plane being 0.30 or less, an intensity ratio of a (111) plane being 0.45 or less, and an intensity ratio of a (311) plane being 0.60 or less. The intensity ratio of the (111) plane is greater than the intensity ratio of the (200) plane and smaller than the intensity ratio of the (311) plane.

7 Claims, 1 Drawing Sheet

(51) Int. Cl.
*C22C 9/06* (2006.01)
*C22F 1/08* (2006.01)
*C22F 1/00* (2006.01)

(58) Field of Classification Search
USPC ..... 148/433, 435, 432, 553; 420/485
See application file for complete search history.

(56) References Cited

U.S. PATENT DOCUMENTS

| | | | | |
|---|---|---|---|---|
| 2002/0127133 | A1* | 9/2002 | Usami | C22C 9/02 420/485 |
| 2006/0016528 | A1 | 1/2006 | Hatakeyama | |
| 2006/0201591 | A1* | 9/2006 | Kawahata | C22C 9/06 148/553 |
| 2007/0131321 | A1 | 6/2007 | Kaneko et al. | |
| 2009/0257909 | A1* | 10/2009 | Mihara | C22F 1/08 420/485 |
| 2010/0047112 | A1 | 2/2010 | Fugono et al. | |
| 2013/0014861 | A1* | 1/2013 | Ookubo | C22F 1/08 148/554 |

FOREIGN PATENT DOCUMENTS

| | | | |
|---|---|---|---|
| JP | 55 148740 | 11/1980 | |
| JP | 63 266055 | 11/1988 | |
| JP | 63 317636 | 12/1988 | |
| JP | 2 225651 | 9/1990 | |
| JP | 6 41660 | 2/1994 | |
| JP | 2002 266058 | 9/2002 | |
| JP | 2006 16667 | 1/2006 | |
| JP | 2009 242895 | 10/2009 | |
| WO | WO 2011125153 A1 * | 10/2011 | C22C 9/06 |

OTHER PUBLICATIONS

International Search Report dated Sep. 11, 2012 in PCT/JP12/068937 Filed Jul. 26, 2012.
Chinese Office Action (Application No. 201280074912.2) dated Sep. 8, 2016.
Chinese Office Action, Chinese Application No. 201280074912.2, dated Feb. 25, 2016 (6 pages).

* cited by examiner

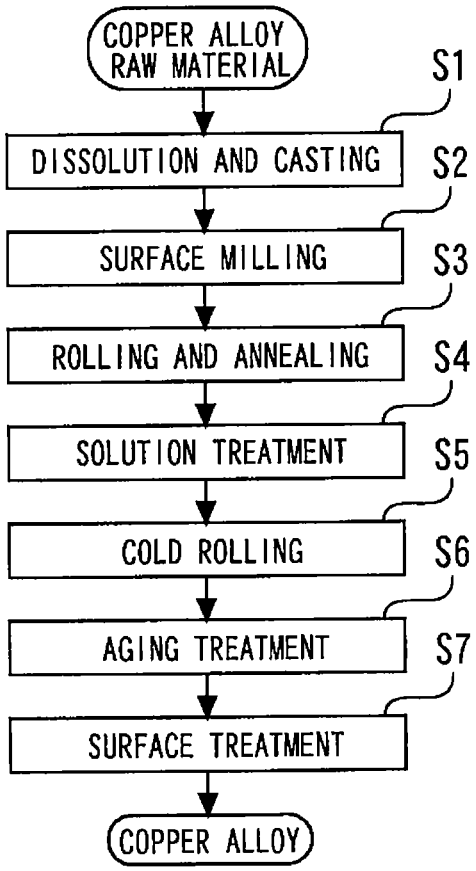
COPPER ALLOY RAW MATERIAL
S1
DISSOLUTION AND CASTING
S2
SURFACE MILLING
S3
ROLLING AND ANNEALING
S4
SOLUTION TREATMENT
S5
COLD ROLLING
S6
AGING TREATMENT
S7
SURFACE TREATMENT
COPPER ALLOY

COPPER ALLOY AND METHOD FOR MANUFACTURING THE SAME

TECHNICAL FIELD

The present invention relates to a copper alloy and a method for manufacturing the same widely used for electric and/or electronic devices.

BACKGROUND ART

Along with the miniaturization of electronic parts, spring members used for the electronic parts are more and more laminated, and therefore it is necessary to further improve their strength and bending workability. Beryllium copper typified by C1720 is known as a copper alloy material for electronic parts provided with both high strength and bending workability. However, with consideration for recent environmental issues, there is a trend toward avoiding the use of alloy materials containing Be.

Thus, Cu—Ni—Sn-based alloys are becoming a focus of attention as copper alloys taking the place of beryllium copper. For this Cu—Ni—Sn-based alloy, a modulation structure is formed through aging treatment, and as a result, the Cu—Ni—Sn-based alloy is known to be an alloy that provides high strength. Studies have been carried out so far on its composition, working, heat treatment, elements added and structure, and it has been reported that the Cu—Ni—Sn-based alloy can further improve strength and bending workability.

As a conventional Cu—Ni—Sn-based alloy, an alloy is disclosed which contains, as principal ingredients, 3 to 12 mass % of Ni, 3 to 9 mass % of Sn and Cu as the remainder in order to improve bending workability, and is subjected to (1) heat treatment at 730 to 770° C. for 1 to 3 minutes prior to final finishing of the alloy, (2) rapid cooling quenching, (3) 55 to 70% cold working, and (4) heat treatment at 400 to 500° C. for less than 1 to 3 minutes (e.g., see Patent Literature 1).

Moreover, as another conventional Cu—Ni—Sn-based alloy, an alloy is disclosed which contains, as principal ingredients, 5 to 20 mass % of Ni, 5 to 10 mass % of Sn and Cu as the remainder and in which a ratio of an average diameter x of crystal grains in a plate width direction to an average diameter y parallel to a rolling direction (y/x) is set to 1.2 to 12, and $0<x\leq15$ and the number of second-phase grains having a major axis of 0.1 μm or more observed by a cross section speculum is assumed to be $1.0\times10^5/mm^2$ or less (e.g., see Patent Literature 2).

CITATION LIST

Patent Literature

Patent Literature 1: Japanese Patent Laid-Open No. 2002-266058

Patent Literature 2: Japanese Patent Laid-Open No. 2009-242895

SUMMARY OF INVENTION

Technical Problem

Patent Literature 1 considers the composition of a copper alloy, but does not consider crystal orientation of the copper alloy. This results in a problem that the copper alloy has no appropriate organizational structure and either strength or bending workability is not sufficient.

On the other hand, Patent Literature 2 considers crystal grains and the number of minute second-phase grains, and discloses bending workability by 90° W bending before aging treatment. However, bending workability in a stage in which the strength is increased after aging treatment is not considered. Furthermore, it is disclosed that in an alloy of Cu, 9.1 mass % of Ni and 6.1 mass % of Sn, or an alloy obtained by singly adding 0.39 mass % of Mn and 0.35 mass % of Si to the composition thereof, crystal grains after solution treatment are 6 to 22 μm. However, crystal grains of less than 6 μm are not obtained. Therefore, there is a problem that bending workability after aging treatment is not sufficient.

The present invention has been implemented to solve the above-described problems and it is an object of the present invention to provide a copper alloy and a method for manufacturing the same capable of simultaneously obtaining high strength and excellent bending workability.

Means for Solving the Problems

A copper alloy according to the present invention is rolled to be plate-shaped wherein the copper alloy contains 8.5 to 9.5 mass % of Ni, 5.5 to 6.5 mass % of Sn with a remainder being Cu and unavoidable impurities, an average diameter of crystal grains in a cross section perpendicular to a rolling direction is less than 6 μm, a ratio x/y of an average length x of the crystal grains in a plate width direction to an average length y in a plate thickness direction satisfies $1\leq x/y\leq2.5$, an X-ray diffracted intensity ratio in a plate surface parallel to the rolling direction of the copper alloy includes, when an X-ray diffracted intensity of a (220) plane is standardized as 1, an intensity ratio of a (200) plane being 0.30 or less, an intensity ratio of a (111) plane being 0.45 or less, and an intensity ratio of a (311) plane being 0.60 or less, and the intensity ratio of the (111) plane is greater than the intensity ratio of the (200) plane and smaller than the intensity ratio of the (311) plane.

Advantageous Effects of Invention

The present invention makes it possible to simultaneously obtain high strength and excellent bending workability.

BRIEF DESCRIPTION OF THE DRAWINGS

FIG. 1 is a flowchart of a production method for the copper alloy according to the embodiment of the present invention.

DESCRIPTION OF EMBODIMENTS

A copper alloy according to an embodiment of the present invention contains 8.5 to 9.5 mass % of Ni, 5.5 to 6.5 mass % of Sn with the remainder being Cu and unavoidable impurities. Here, high strength cannot be obtained if the content of Ni is less than 8.5 mass % or the content of Sn is less than 5.5 mass %. On the other hand, when the content of Ni exceeds 9.5 mass % or the content of Sn exceeds 6.5 mass %, it is not possible to simultaneously obtain high strength and excellent bending workability. The unavoidable impurities mean impurities contained in normal bullion or impurities mixed in production of a copper alloy, such as As, Sb, Bi, Pb, Fe, S, $O_2$, and $H_2$.

When an average diameter of crystal grains of a copper alloy is 6 μm or above, it is not possible to simultaneously obtain high strength and excellent bending workability. Thus, an average diameter of crystal grains in a cross section perpendicular to a rolling direction of the copper alloy of the present embodiment is less than 6 μm.

When a ratio x/y of an average length x of crystal grains in a plate width direction to an average length y in a plate thickness direction is less than 1, cracking caused by bending is more likely to develop in the plate thickness direction. When x/y exceeds 2.5, anisotropy increases and bending workability deteriorates. Thus, the copper alloy of the present embodiment satisfies $1 \leq x/y \leq 2.5$.

The X-ray diffracted intensity ratio in a plate surface parallel to a rolling direction of the copper alloy of the present embodiment is: when the X-ray diffracted intensity of the (220) plane is standardized as 1, the intensity ratio of the (200) plane is 0.30 or less, the intensity ratio of the (111) plane is 0.45 or less, and the intensity ratio of the (311) plane is 0.60 or less. In addition, the intensity ratio of the (111) plane is greater than the intensity ratio of the (200) plane and smaller than the intensity ratio of the (311) plane. This condition is necessary to simultaneously obtain high strength and excellent bending workability. That is, when the intensity ratio of the (111) plane exceeds 0.45, the intensity ratio of the (200) plane exceeds 0.30 or the intensity ratio of the (311) plane exceeds 0.60, it is not possible to simultaneously obtain high strength and excellent bending workability. More specifically, it is preferable that the intensity ratio of the (111) plane be 0.37 to 0.42, the intensity ratio of the (200) plane be 0.22 to 0.28, and the intensity ratio of the (311) plane be 0.45 to 0.57. Moreover, the intensity ratio of the (222) plane is preferably less than 0.04 (including 0).

A maximum height Rz of surface roughness in the vertical direction with respect to the rolling direction of the copper alloy of the present embodiment is 0.6 μm or less. This condition is necessary to obtain stable bending workability. That is, when the maximum height Rz of surface roughness exceeds 0.6 μm, it is not possible to obtain stable bending workability.

Inclusions are precipitated on a grain boundary in the copper alloy. Here, the inclusions are minute precipitation grains produced during production of the copper alloy, and are more specifically oxides generated by reaction with the atmosphere and grains from the Cu—Ni—Sn alloy phase. Moreover, the size of the inclusion is the size of the diameter in the case of a sphere or the size of the major axis or long side in the case of an ellipse or rectangle.

In conventional alloys, inclusions having a grain diameter of 1 μm or less are scattered over the grain boundary and within crystal grains, and particularly when the number of inclusions having a grain diameter of 0.5 to 1 μm located on the grain boundary in a cross-sectional organization of a plane perpendicular to the rolling direction exceeds $5\times10^4$ inclusions/mm$^2$, the grain boundary becomes a starting point of destruction, making it impossible to obtain high strength and causing bending workability to deteriorate. Thus, the present embodiment assumes the number of inclusions having a grain diameter of 0.5 to 1 μm located on the grain boundary in a cross-sectional organization of a plane perpendicular to the rolling direction to be $5\times10^4$ inclusions/mm$^2$ or less.

The copper alloy of the present embodiment may contain a total amount of 0.1 to 1.0 mass % of two or more elements selected from among Mn, Si and P. This will improve bending workability due to refining of crystal grains, and dissolution to a parent phase improves strength and also improves corrosion resistance. However, when the total amount is less than 0.1 mass %, this does not contribute to characteristic improvement, whereas when the total amount exceeds 1.0 mass %, the strength increases but bending workability and conductivity deteriorate.

Next, FIG. 1 is a flowchart of a production method for the copper alloy according to the embodiment of the present invention. The production method for the copper alloy of the present embodiment will be described according to this flowchart.

First, a copper alloy raw material containing 8.5 to 9.5 mass % of Ni, 5.5 to 6.5 mass % of Sn with the remainder being Cu and unavoidable impurities is dissolved in a high-frequency furnace and a plate-shaped ingot of 60 mm wide and 10-mm thick is then cast (step S1). The method of dissolving the copper alloy raw material is not particularly limited and the copper alloy raw material may be heated to a temperature equal to or higher than a melting point using a publicly known apparatus such as a high-frequency furnace.

Next, the copper alloy raw material is subjected to surface milling to remove an oxide film or the like from the ingot surface and an ingot having a thickness of 5 mm is obtained (step S2). Next, the surface-milled ingot is subjected to rolling at a room temperature, heated, water-cooled and annealed at 800° C. for five minutes from the viewpoint of removing stress inside the alloy, and then further subjected to rolling at a room temperature again to obtain a rolled material having a thickness of 0.22 mm (step S3).

Next, the rolled material having a thickness of 0.22 mm is heated at 780 to 900° C. (preferably 800 to 850° C.), then rapidly cooled in water and subjected to solution treatment (step S4). Furthermore, to remove the oxide film on the surface formed through the solution treatment, the rolled material is subjected to surface treatment by the combined use of acid treatment and buffing to make the thickness of the rolled material 0.2 mm.

The heating time may vary depending on the size of the rolled material or the specification of the furnace, but it is preferably 20 seconds to 300 seconds to avoid coarsening of crystal grains. In this way, satisfactory dissolution of the alloy elements and crystal grains can be achieved. An average diameter of crystal grains of the rolled material on a cross section perpendicular to the rolling direction after the solution treatment is set to less than 6 μm, and more preferably 4 μm or less. It is thereby possible to improve bending workability. When the average diameter of crystal grains is 6 μm or above, the ratio R/t of a minimum value R of the bending radius which would not produce any cracking with 180° bending to a specimen thickness t cannot be set to 1 or less.

Next, the rolled material having a thickness of 0.2 mm is subjected to cold rolling at a reduction ratio of 6 to 12% (step S5). A reduction ratio of less than 6% may be effective in obtaining bending workability, but desired tensile strength cannot be achieved. On the other hand, a reduction ratio exceeding 12% may be effective in obtaining the strength, but bending workability cannot be achieved. Note that the reduction ratio r is defined as $r=(t_0-t)/(t_0)\times100$ ($t_0$: plate thickness before rolling, t: plate thickness after rolling). For example, a maximum height Rz of the material surface is set to 0.6 μm or less using a rolling roll having a surface roughness of less than 0.6 μm.

Next, as aging treatment, the thin plate is subjected to heat treatment at 270 to 400° C. for two hours (step S6). The heating time is preferably 30 to 360 minutes. Moreover, aging treatment may be performed in two stages.

Finally, surface treatment is performed to remove the oxide film formed on the surface through heat treatment (step S7). In this case, the surface is finished to a surface roughness having a maximum height of 0.6 μm or less.

The copper alloy of the present embodiment is produced in the above-described steps. In the above-described steps, the methods for casting, surface milling, rolling, annealing, heating and rapid cooling are not particularly limited, and publicly known methods may be used. In addition, the method for surface treatment is not particularly limited either, and publicly known methods may be used. For example, acid treatment, buffing or a combination thereof may be used.

Next, effects of the present embodiment will be described in comparison with comparative examples. Characteristics of the copper alloys according to the embodiment and comparative examples were evaluated as follows.

(1) A tensile specimen was extracted so that the length direction of the tensile specimen became parallel to the rolling direction and tensile strength thereof was evaluated based on JIS Z 2241.

(2) Bending workability was evaluated based on 180° bending testing of JIS Z 2248. A JBMA T307 compliant specimen perpendicular to the rolling direction was extracted and Bad way bending thereof was evaluated. To evaluate bending workability, the surface of a bent distal end portion thereof was observed using an optical microscope and a ratio (R/t) of a minimum value R of the bending radius within which no cracking is produced to a specimen thickness t was calculated.

(3) An average crystal grain size was measured based on a cutting method compliant with JIS H 0551. As for a metallographic structure for measuring the average crystal grain size, a cross section perpendicular to the rolling direction was polished, then etched and the structure was thereby exposed. Three optionally selected locations were photographed using an optical microscope and an average crystal grain size was determined from a ×1000 photo using a cutting method.

(4) As for crystal orientation of the crystal plane, peak intensities of the (220) plane, (111) plane, (200) plane, (311) plane and (222) plane were measured by means of X-ray diffraction through an X-ray diffraction analysis using an X-ray diffraction apparatus manufactured by Rigaku Corporation. Standardization was performed assuming the X-ray diffracted intensity of the (220) plane to be 1 and X-ray diffracted intensity of each plane with respect to the (220) plane was calculated.

(5) The surface roughness was measured based on JIS B 0601 and a maximum height Rz was determined from a roughness curve in a direction perpendicular to the rolling direction.

(6) The number of inclusions located on the grain boundary per unit $mm^2$ and the sizes of the inclusions were determined using the following method. First, the cross section perpendicular to the rolling direction was polished, then etched and the structure was thereby exposed. Next, 10 optionally selected locations were photographed at ×5000 using an electronic microscope, a square region of 15 μm high and 20 μm wide (area of 300 $\mu m^2$) was set on an optional part of the photo and the number of inclusions and the sizes of the inclusions scattered over the grain boundary per 300 $\mu m^2$ were measured. The number of inclusions was converted to a value per unit $mm^2$ and the number of inclusions located on the grain boundary was determined. The size of the inclusion was determined from the photo as the size of the diameter if the inclusion was a sphere and as the size of the major axis if the inclusion was an ellipse, and an average value was calculated as the sum total of the sizes of inclusions measured÷the number of inclusions measured.

Table 1 is a table listing data of the copper alloys of the embodiment and comparative example. In this table, the amount of Cu is not shown explicitly, but can be estimated from the amounts of other components.

TABLE 1

| | | Composition (mass %) | | | | | | Crystal grain diameter after solution treatment (μm) | Cold rolling reduction ratio before aging treatment (%) | Crystal grain diameter of copper alloy | | Surface roughness | X-ray diffracted intensity ratio of plate surface after aging treatment | |
|---|---|---|---|---|---|---|---|---|---|---|---|---|---|---|
| | Number | Ni | Sn | Mn | Si | P | Total amount of Mn, Si and P | | | Average crystal grain (μm) | X/Y | Maximum height (μm) | (111) plane | (200) plane |
| Embodiment | 1 | 9 | 6 | — | — | — | — | 4.0 | 10 | 4.0 | 1.5 | 0.4 | 0.45 or less | 0.3 or less |
| | 2 | 9.5 | 5.5 | — | — | — | — | 4.0 | 10 | 4.0 | 1.5 | 0.5 | 0.45 or less | 0.3 or less |
| | 3 | 8.5 | 6.5 | — | — | — | — | 4.0 | 10 | 4.0 | 1.5 | 0.5 | 0.45 or less | 0.3 or less |
| | 4 | 9.5 | 6.5 | — | — | — | — | 1.0 | 10 | 1.0 | 1.5 | 0.5 | 0.45 or less | 0.3 or less |
| | 5 | 9 | 6 | — | — | — | — | 5.9 | 10 | 6.0 | 1.5 | 0.5 | 0.45 or less | 0.3 or less |
| | 6 | 9 | 6 | — | — | — | — | 4.0 | 10 | 4.0 | 1.5 | 0.1 | 0.45 or less | 0.3 or less |
| | 7 | 9 | 6 | — | — | — | — | 4.2 | 10 | 4.0 | 1.5 | 0.6 | 0.45 or less | 0.3 or less |
| | 8 | 9 | 6 | — | — | — | — | 4.0 | 6 | 4.0 | 1 | 0.5 | 0.45 or less | 0.3 or less |
| | 9 | 9 | 6 | — | — | — | — | 4.0 | 12 | 4.0 | 2.5 | 0.5 | 0.45 or less | 0.3 or less |
| | 10 | 9 | 6 | 0.5 | 0.2 | — | 0.7 | 2.0 | 10 | 3.0 | 1.5 | 0.5 | 0.45 or less | 0.3 or less |
| | 11 | 9 | 6 | 0.2 | 0.05 | — | 0.25 | 2.0 | 10 | 3.0 | 1.5 | 0.5 | 0.45 or less | 0.3 or less |
| | 12 | 9 | 6 | 0.5 | — | 0.02 | 0.52 | 3.0 | 10 | 3.0 | 1.5 | 0.5 | 0.45 or less | 0.3 or less |
| | 13 | 9 | 6 | 0.6 | 0.2 | 0.2 | 1 | 1.0 | 10 | 2.0 | 1.5 | 0.5 | 0.45 or less | 0.3 or less |
| | 14 | 9 | 6 | 0.05 | 0.04 | 0.01 | 0.1 | 4.0 | 10 | 4.0 | 1.5 | 0.5 | 0.45 or less | 0.3 or less |
| | 15 | 9 | 6 | — | 0.05 | 0.05 | 0.1 | 4.0 | 10 | 4.0 | 1.5 | 0.5 | 0.45 or less | 0.3 or less |
| | 16 | 9 | 6 | 0.35 | 0.08 | 0.02 | 0.45 | 3.0 | 10 | 3.0 | 1.5 | 0.5 | 0.45 or less | 0.3 or less |
| Comparative example | 17 | 12 | 7 | — | — | — | — | 4.0 | 10 | 4.0 | 1.5 | 0.5 | 0.45 or less | 0.3 or less |
| | 18 | 7 | 4 | — | — | — | — | 8.0 | 10 | 4.0 | 1.5 | 0.5 | 0.45 or less | 0.3 or less |
| | 19 | 9 | 6 | — | — | — | — | 8.0 | 10 | 4.0 | 1.5 | 0.8 | Over 0.45 | Over 0.3 |
| | 20 | 9 | 6 | — | — | — | — | 5.0 | 0 | 4.0 | 1.5 | 0.5 | Over 0.45 | Over 0.3 |
| | 21 | 9 | 6 | — | — | — | — | 4.0 | 15 | 4.0 | 1.5 | 0.5 | Over 0.45 | Over 0.3 |
| | 22 | 9 | 6 | — | — | — | — | 4.0 | 10 | 4.0 | 1.5 | 0.5 | 0.45 or less | Over 0.3 |

TABLE 1-continued

| | | | | | | | | | | | | | |
|---|---|---|---|---|---|---|---|---|---|---|---|---|---|
| 23 | 9 | 6 | — | — | — | — | 4.0 | 10 | 4.0 | 1.5 | 0.4 | Over 0.45 | 0.3 or less |
| 24 | 9 | 6 | 0.02 | 0.01 | 0.01 | 0.04 | 4.0 | 10 | 4.0 | 1.5 | 0.4 | 0.45 or less | 0.3 or less |
| 25 | 9 | 6 | 1 | 0.5 | 0.5 | 2 | 2.0 | 10 | 4.0 | 1.5 | 0.4 | 0.45 or less | 0.3 or less |

| | | X-ray diffracted intensity ratio of plate surface after aging treatment | | Characteristics after aging treatment | | | Inclusion of 0.5 to 1 μm located on | Solution treatment conditions | | Aging treatment conditions | |
|---|---|---|---|---|---|---|---|---|---|---|---|
| | Number | (311) plane | Relationship between intensity ratios | Bending workability (R/t) | Tensile strength ($N/mm^2$) | Conductivity (% IACS) | grain boundary (Inclusions/$mm^2$) | Temperature (° C.) | Time (sec) | Temperature (° C.) | Time (h) |
| Embodiment | 1 | 0.60 or less | 200 < 111 < 311 | 1 | 945 | 12 | $5 \times 10^4$ or less | 850 | 40 | 350 | 2 |
| | 2 | 0.60 or less | 200 < 111 < 311 | 1 | 950 | 12 | $5 \times 10^4$ or less | 850 | 40 | 350 | 2 |
| | 3 | 0.60 or less | 200 < 111 < 311 | 1 | 959 | 12 | $5 \times 10^4$ or less | 850 | 40 | 350 | 2 |
| | 4 | 0.60 or less | 200 < 111 < 311 | 1 | 960 | 12 | $5 \times 10^4$ or less | 850 | 40 | 350 | 2 |
| | 5 | 0.60 or less | 200 < 111 < 311 | 1 | 945 | 12 | $5 \times 10^4$ or less | 850 | 40 | 350 | 2 |
| | 6 | 0.60 or less | 200 < 111 < 311 | 1 | 950 | 12 | $5 \times 10^4$ or less | 850 | 40 | 350 | 2 |
| | 7 | 0.60 or less | 200 < 111 < 311 | 1 | 952 | 12 | $5 \times 10^4$ or less | 850 | 40 | 350 | 2 |
| | 8 | 0.60 or less | 200 < 111 < 311 | 1 | 930 | 12 | $5 \times 10^4$ or less | 850 | 40 | 350 | 2 |
| | 9 | 0.60 or less | 200 < 111 < 311 | 1 | 965 | 12 | $5 \times 10^4$ or less | 850 | 40 | 350 | 2 |
| | 10 | 0.60 or less | 200 < 111 < 311 | 1 | 955 | 12 | $5 \times 10^4$ or less | 850 | 40 | 350 | 2 |
| | 11 | 0.60 or less | 200 < 111 < 311 | 1 | 953 | 12 | $5 \times 10^4$ or less | 850 | 40 | 350 | 2 |
| | 12 | 0.60 or less | 200 < 111 < 311 | 1 | 955 | 12 | $5 \times 10^4$ or less | 850 | 40 | 350 | 2 |
| | 13 | 0.60 or less | 200 < 111 < 311 | 1 | 965 | 10 | $5 \times 10^4$ or less | 850 | 40 | 350 | 2 |
| | 14 | 0.60 or less | 200 < 111 < 311 | 1 | 955 | 12 | $5 \times 10^4$ or less | 850 | 40 | 350 | 2 |
| | 15 | 0.60 or less | 200 < 111 < 311 | 1 | 952 | 12 | $5 \times 10^4$ or less | 850 | 40 | 350 | 2 |
| | 16 | 0.60 or less | 200 < 111 < 311 | 1 | 961 | 12 | $5 \times 10^4$ or less | 850 | 40 | 350 | 2 |
| Comparative example | 17 | 0.60 or less | 200 < 111 < 311 | 4 | 1050 | 7 | $5 \times 10^4$ or less | 850 | 40 | 350 | 2 |
| | 18 | 0.60 or less | 200 < 111 < 311 | 6 | 850 | 13 | $5 \times 10^4$ or less | 850 | 40 | 350 | 2 |
| | 19 | 0.60 or less | 200 < 311 < 111 | 1.5 | 930 | 12 | Over $5 \times 10^4$ | 850 | 40 | 350 | 2 |
| | 20 | Over 0.60 | 200 < 111 < 311 | 2 | 800 | 12 | Over $5 \times 10^4$ | 900 | 40 | 350 | 2 |
| | 21 | Over 0.60 | 200 < 311 < 111 | 2 | 971 | 12 | Over $5 \times 10^4$ | 850 | 40 | 350 | 2 |
| | 22 | 0.60 or less | 200 < 111 < 311 | 1.5 | 930 | 12 | $5 \times 10^4$ or less | 850 | 40 | 500 | 0.5 |
| | 23 | 0.60 or less | 200 < 311 < 111 | 4 | 600 | 7 | Over $5 \times 10^4$ | 850 | 40 | 700 | 0.5 |
| | 24 | 0.60 or less | 200 < 111 < 311 | 1 | 930 | 12 | $5 \times 10^4$ or less | 850 | 40 | 350 | 2 |
| | 25 | 0.60 or less | 200 < 111 < 311 | 3 | 980 | 7 | $5 \times 10^4$ or less | 850 | 40 | 350 | 2 |

Numbers 1 to 9 of the embodiment correspond to cases where impurities are not contained and numbers 10 to 16 correspond to cases where 0.1 to 1 mass % of Mn, Si and P in total are contained. In all cases, the bending workability R/t after aging treatment is 1 and tensile strength is 930 $N/mm^2$ or more. When Mn, Si and P are contained, high strength can be obtained due to the refining of crystal grains.

Numbers 17 and 18 in the comparative example are cases where the composition does not correspond to the present embodiment. Numbers 19 to 23 in the comparative example correspond to cases where the X-ray diffracted intensity ratio is outside the range of the present embodiment or the number of inclusions on the grain boundary is greater than that described in the appended claims. In these cases, either bending workability or tensile strength does not satisfy target characteristics.

Number 24 in the comparative example corresponds to a case where less than 0.1 mass % of Mn, Si and P in total are contained, and exhibits tensile strength equivalent to that of number 1 of the embodiment and has no effect of increasing strength by dosage. Number 25 in the comparative example corresponds to a case where 1 mass % or more of Mn, Si and P in total are contained, in which case high strength is obtained but bending workability is not satisfied.

As described above, the copper alloy of the present embodiment can achieve an optimum organizational structure and can simultaneously satisfy tensile strength of 930 $N/mm^2$ or more and bending workability R/t in 180° bending in Bad way of 1 or less.

The invention claimed is:

1. A copper alloy, comprising:

8.5 to 9.5 mass % of Ni, 5.5 to 6.5 mass % of Sn, and wherein the copper alloy is rolled to be plate-shaped, an average diameter of crystal grains in a cross section perpendicular to a rolling direction is less than 6 μm, a ratio x/y of an average length x of the crystal grains in a plate width direction to an average length y in a plate thickness direction satisfies $1 \leq x/y \leq 2.5$, an X-ray diffracted intensity ratio in a plate surface parallel to the rolling direction of the copper alloy includes, when an X-ray diffracted intensity of a (220) plane is standardized as 1, an intensity ratio of a (200) plane being 0.30 or less, an intensity ratio of a (111) plane being 0.45 or less, and an intensity ratio of a (311) plane being 0.60 or less, and the intensity ratio of the (111) plane is greater than the intensity ratio of the (200) plane and smaller than the intensity ratio of the (311) plane.

2. The copper alloy according to claim 1, wherein a maximum height of surface roughness in a vertical direction with respect to the rolling direction is 0.6 μm or less.

3. The copper alloy according to claim 1, further comprising:

a total amount of 0.1 to 1.0 mass % of two or more elements selected from the group consisting of Mn, Si and P.

4. The copper alloy according to claim 1, wherein a number density of inclusions having a grain diameter of from 0.5 to 1 μm located at a grain boundary in a cross-section perpendicular to the rolling direction is $5 \times 10^4$ inclusions/$mm^2$ or less.

5. The copper alloy according to claim 2, further comprising:

a total amount of 0.1 to 1.0 mass % of two or more elements selected from the group consisting of Mn, Si and P.

6. The copper alloy according to claim 2, wherein a number density of inclusions having a grain diameter of from 0.5 to 1 μm located on a grain boundary in a cross-sectional organization of a plane perpendicular to the rolling direction is $5\times10^4$ inclusions/$mm^2$ or less.

7. The copper alloy according to claim 3, wherein a number density of inclusions having a grain diameter of from 0.5 to 1 μm located on a grain boundary in a cross-sectional organization of a plane perpendicular to the rolling direction is $5\times10^4$ inclusions/$mm^2$ or less.

* * * * *